US007762336B2

(12) United States Patent
Johnson et al.

(10) Patent No.: US 7,762,336 B2
(45) Date of Patent: Jul. 27, 2010

(54) FLAPPER LATCH

(75) Inventors: Eric T. Johnson, Sugar Land, TX (US); John Lee Emerson, Katy, TX (US); Michael Foster, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/061,475

(22) Filed: Apr. 2, 2008

(65) Prior Publication Data

US 2008/0210431 A1 Sep. 4, 2008

Related U.S. Application Data

(63) Continuation-in-part of application No. 11/761,229, filed on Jun. 11, 2007, now Pat. No. 7,673,689.

(60) Provisional application No. 60/804,547, filed on Jun. 12, 2006.

(51) Int. Cl.
*E21B 34/12* (2006.01)
*F16K 15/03* (2006.01)
*F16K 1/20* (2006.01)

(52) U.S. Cl. ..... 166/332.7; 166/323; 166/373; 251/303; 137/527

(58) Field of Classification Search ..... 166/373–375, 166/316, 319, 321, 323, 325, 332.1, 332.7, 166/332.8; 251/228, 298, 303; 137/247.19, 137/520, 521, 527
See application file for complete search history.

(56) References Cited

U.S. PATENT DOCUMENTS 1,871,536 A * 8/1932 Le Bus ..... 137/515
2,064,247 A * 12/1936 Evans ..... 417/115
3,687,157 A * 8/1972 Whitmer ..... 137/527
4,154,303 A * 5/1979 Fournier ..... 166/317

(Continued)

FOREIGN PATENT DOCUMENTS

GB 2 313 610 12/1997

(Continued)

OTHER PUBLICATIONS

Protecting Formations, FIV Technology, Schlumberger, (2 pages).

(Continued)

*Primary Examiner*—Kenneth Thompson
(74) *Attorney, Agent, or Firm*—Patterson & Sheridan, LLP

(57) ABSTRACT

The present invention generally relates to a method and an apparatus for selectively isolating a portion of a wellbore. In one aspect, an apparatus for isolating a zone in a wellbore is provided. The apparatus includes a body having a bore. The apparatus further includes a first flapper member and a second flapper member, each flapper member selectively rotatable between an open position and a closed position. Additionally, the apparatus includes a flapper latch assembly disposed in the bore, the flapper latch assembly movable between an unlocked position and a locked position, wherein the flapper latch assembly is configured to hold the first flapper member in the closed position when the flapper latch assembly is in the locked position. In another aspect, a method for selectively isolating a zone in a wellbore is provided. In yet a further aspect, a flapper latch assembly for use with a flapper valve is provided.

40 Claims, 7 Drawing Sheets

U.S. PATENT DOCUMENTS

| | | | | |
|---|---|---|---|---|
| 4,161,985 | A | 7/1979 | Fournier et al. | |
| 4,220,206 | A * | 9/1980 | Van Winkle | 166/318 |
| 4,378,818 | A * | 4/1983 | Cormier, Jr. | 137/523 |
| 4,469,179 | A * | 9/1984 | Crow et al. | 166/319 |
| 4,561,630 | A * | 12/1985 | McCulloch | 251/84 |
| 4,926,945 | A | 5/1990 | Pringle et al. | |
| 5,095,937 | A | 3/1992 | LeBlanc et al. | |
| 5,141,020 | A * | 8/1992 | Sunderhaus et al. | 137/467 |
| 5,236,009 | A * | 8/1993 | Ackroyd | 137/527 |
| 5,372,193 | A | 12/1994 | French | |
| 5,810,087 | A | 9/1998 | Patel | |
| 5,857,523 | A * | 1/1999 | Edwards | 166/374 |
| 5,950,733 | A | 9/1999 | Patel | |
| 6,015,014 | A | 1/2000 | Macleod et al. | |
| 6,152,224 | A | 11/2000 | French | |
| 6,220,355 | B1 | 4/2001 | French | |
| 6,230,808 | B1 | 5/2001 | French et al. | |
| 6,286,594 | B1 | 9/2001 | French | |
| 6,289,991 | B1 | 9/2001 | French | |
| 6,328,109 | B1 * | 12/2001 | Pringle et al. | 166/373 |
| 6,334,633 | B1 | 1/2002 | Nguyen et al. | |
| 6,494,269 | B2 | 12/2002 | French et al. | |
| 6,508,309 | B1 | 1/2003 | French | |
| 6,595,296 | B1 | 7/2003 | French | |
| 6,840,321 | B2 | 1/2005 | Restarick et al. | |
| 6,904,975 | B2 * | 6/2005 | Horne et al. | 166/386 |
| 7,204,315 | B2 | 4/2007 | Pia | |
| 2002/0070028 | A1 * | 6/2002 | Garcia et al. | 166/373 |
| 2004/0020657 | A1 | 2/2004 | Patel | |
| 2008/0245531 | A1 * | 10/2008 | Noske et al. | 166/373 |

FOREIGN PATENT DOCUMENTS

| | | |
|---|---|---|
| GB | 2 411 193 | 8/2005 |
| GB | 2 439 187 | 12/2007 |
| WO | WO 2006/081015 | 8/2006 |

OTHER PUBLICATIONS

GB Search Report for GB Application No. GB0711156.0 dated Sep. 7, 2007.
GB Search Report for GB Application No. GB0711156.0 dated Jan. 15, 2008.
Canada Office Action for Canadian Application No. 2,591,360 dated May 7, 2009.
GB Search Report for GB Application No. 0904763.0 dated Jul. 29, 2009.
Office Action for U.S. Appl. No. 11/761,229 dated Dec. 29, 2008.
Response to Office Action dated Dec. 29, 2008 for U.S. Appl. No. 11/761,229.
Final Office Action for U.S. Appl. No. 11/761,229 dated Jun. 5, 2009.
Response to Final Office Action dated Jun. 5, 2009 for U.S. Appl. No. 11/761,229.
Advisory Action for U.S. Appl. No. 11/761,229 dated Sep. 16, 2009.
Canadian Office Action for Application No. 2,660,919 dated Mar. 26, 2010.

* cited by examiner

FLAPPER LATCH

CROSS-REFERENCE TO RELATED APPLICATIONS

This application is a continuation-in-part of U.S. patent application Ser. No. 11/761,229, filed Jun. 11, 2007 now U.S. Pat. No. 7,673,689, which claims benefit of U.S. provisional patent application Ser. No. 60/804,547, filed Jun. 12, 2006. Each of the aforementioned related patent applications is herein incorporated by reference.

BACKGROUND OF THE INVENTION

1. Field of the Invention

Embodiments of the present invention generally relate to a wellbore tool for selectively isolating a zone in a wellbore. More particularly, the invention relates to a flapper latch for use with the wellbore tool.

2. Description of the Related Art

A completion operation typically occurs during the life of a well in order to allow access to hydrocarbon reservoirs at various elevations. Completion operations may include pressure testing tubing, setting a packer, activating safety valves or manipulating sliding sleeves. In certain situations, it may be desirable to isolate a portion of the completion assembly from another portion of the completion assembly in order to perform the completion operation. Typically, a ball valve, which is referred to as a formation isolation valve (FIV), is disposed in the completion assembly to isolate a portion of the completion assembly.

Generally, the ball valve includes a valve member configured to move between an open position and a closed position. In the open position, the valve member is rotated to align a bore of the valve member with a bore of the completion assembly to allow the flow of fluid through the completion assembly. In the closed position, the valve member is rotated to misalign the bore in the valve member with the bore of the completion assembly to restrict the flow of fluid through the completion assembly, thereby isolating a portion of the completion assembly from another portion of the completion assembly. The valve member is typically hydraulically shifted between the open position and the closed position.

Although the ball valve is functional in isolating a portion of the completion assembly from another portion of the completion assembly, there are several drawbacks in using the ball valve in the completion assembly. For instance, the ball valve takes up a large portion of the bore in the completion assembly, thereby restricting the bore diameter of the completion assembly. Further, the ball valve is susceptible to debris in the completion assembly which may cause the ball valve to fail to operate properly. Additionally, if the valve member of the ball valve is not fully rotated to align the bore of the valve member with the bore of the completion assembly, then there is no full bore access of the completion assembly.

There is a need therefore, for a downhole tool that is less restrictive of a bore diameter in a completion assembly. There is a further need for a downhole tool that is debris tolerant. There is a further need for a downhole tool having a flapper latch assembly that is configured to maintain a flapper valve in a closed position.

SUMMARY OF THE INVENTION

The present invention generally relates to a method and an apparatus for selectively isolating a portion of a wellbore. In one aspect, an apparatus for isolating a zone in a wellbore is provided. The apparatus includes a body having a bore. The apparatus further includes a first flapper member and a second flapper member disposed in the bore, each flapper member selectively rotatable between an open position and a closed position multiple times, wherein the first flapper member is rotated from the open position to the closed position in a first direction and the second flapper member is rotated from the open position to the closed position in a second direction. Additionally, the apparatus includes a flapper latch assembly disposed in the bore, the flapper latch assembly movable between an unlocked position and a locked position, wherein the flapper latch assembly is configured to hold the first flapper member in the closed position when the flapper latch assembly is in the locked position.

In another aspect, a method for selectively isolating a zone in a wellbore is provided. The method includes positioning a downhole tool in the wellbore, the downhole tool having a body, a first flapper member, a second flapper member and a flapper latch assembly, whereby each flapper member is initially in an open position. The method also includes moving the first flapper member to a closed position by rotating the first flapper member in a first direction. Further, the method includes moving the second flapper member to a closed position by rotating the second flapper member in a second direction. Additionally, the method includes moving a flapper latch assembly from an unlocked position to a locked position, whereby the flapper latch assembly is configured to hold the first flapper member in the closed position when the flapper latch assembly is in the locked position.

In yet a further aspect, a flapper latch assembly for use with a flapper valve is provided. The flapper latch assembly includes a body rotatable between an unlocked position and a locked position, wherein the body includes an end configured to engage a portion of the flapper valve when the flapper valve is in a closed position and the body is in the locked position. Additionally, the method includes a biasing member attached to the body, wherein the biasing member is configured to bias the body in the locked position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
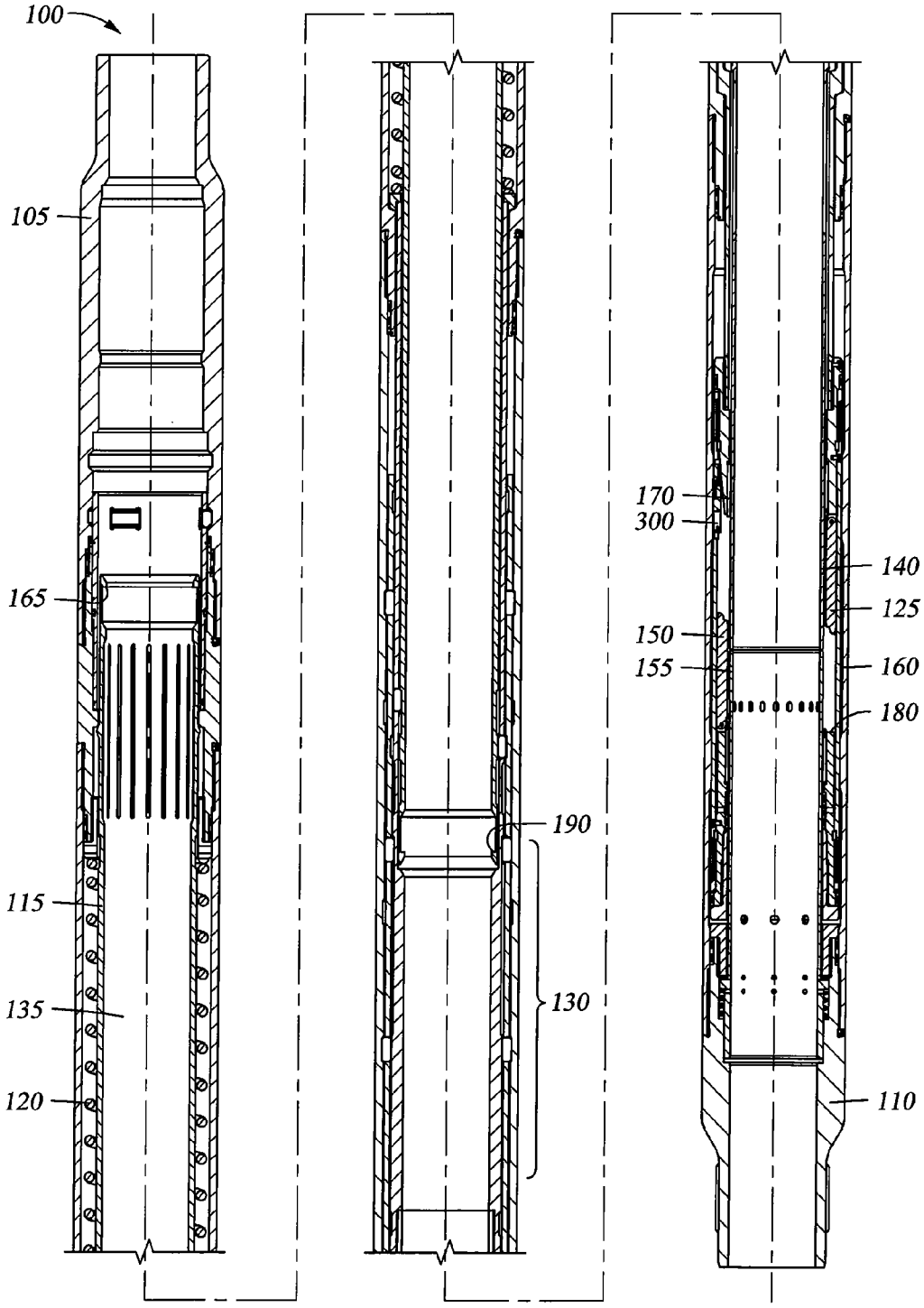
FIG. 1 is a cross-sectional view illustrating a downhole tool with a first flapper valve and a second flapper valve.

FIG. 1 is a cross-sectional view illustrating a downhole tool 100. The tool 100 includes an upper sub 105, a housing 160, and a lower sub 110. The upper sub 105 is configured to be connected to an upper completion assembly (not shown), such as a packer arrangement. The lower sub 110 is configured to be connected to a lower completion assembly (not shown). Generally, the tool 100 is used to selectively isolate the upper completion assembly from the lower completion assembly.

The tool 100 includes a first flapper valve 125 and a second flapper valve 150. The valves 125, 150 are movable between an open position and a closed position multiple times. As shown in FIG. 1, the valves 125, 150 are in the open position when the tool 100 is run into the wellbore. Generally, the valves 125, 150 are used to open and close a bore 135 of the tool 100 in order to selectively isolate a portion of the wellbore above the tool 100 from a portion of the wellbore below the tool 100.

The valves 125, 150 may move between the open position and the closed position in a predetermined sequence. For instance, in a closing sequence, the first flapper valve 125 is moved to the closed position and then the second flapper valve 150 is moved to the closed position as will be described in relation to FIGS. 2-4. In an opening sequence, the second flapper valve 150 is moved to the open position and then the first flapper valve 125 is moved to the open position as will be described in relation to FIGS. 5-6. The particular sequence facilitates proper functioning of the tool 100. For example, in the opening sequence, the second flapper valve 150 is moved to the open position first in order to allow the second flapper valve 150 to open in a substantially clean environment defined between the flapper valves 125, 150, since the first flapper valve 125 is configured to substantially block debris from contacting the second flapper valve 150 when the first flapper valve 125 is in the closed position. In the closing sequence, the first flapper valve 125 is moved to the closed position first in order to substantially protect the second flapper valve 150 from debris that may be dropped from the surface of the wellbore. It must be noted that the valves 125, 150 may be operated according to other suitable sequences.

As illustrated in FIG. 1, the first flapper valve 125 is held in the open position by an upper flow tube 140, and the second flapper valve 150 is held in the open position by a lower flow tube 155. It should be noted that the flapper valves 125, 150 may be a curved flapper valve, a flat flapper valve, or any other suitable valve without departing from principles of the present invention. Further, the opening and closing orientation of the valves 125, 150 may be rearranged into any configuration without departing from principles of the present invention. Additionally, the second flapper valve 150 may be positioned at a location above the first flapper valve 125 without departing from principles of the present invention.

The tool 100 also includes a shifting sleeve 115 with a profile 165 proximate one end and a profile 190 proximate another end. The tool 100 further includes a spring 120 and a shift and lock mechanism 130. As discussed herein, the shift and lock mechanism 130 interacts with the spring 120, the shifting sleeve 115, and the upper tubes 140, 155 in order to move the flapper valves 125, 150 between the open position and the closed position.

As shown in FIG. 1, the shift and lock mechanism 130 is a key and dog arrangement, whereby a plurality of dogs move in and out of a plurality of keys formed in the sleeves as the sleeves are shifted in the tool 100. The movement of the dogs and the sleeves causes the flapper valves 125, 150 to move between the open position and the closed position. It should be understood, however, that the shift and lock mechanism 130 may be any type of arrangement capable of causing the flapper valves 125, 150 to move between the open and the closed position without departing from principles of the present invention. For instance, the shift and lock mechanism 130 may be a motor that is actuated by a hydraulic control line or an electric control line. The shift and lock mechanism 130 may be an arrangement that is controlled by fiber optics, a signal from the surface, an electric line, or a hydraulic line. Further, the shift and lock mechanism 130 may be an arrangement that is controlled by a pressure differential between an annulus and a tubing pressure or a pressure differential between a location above and below the tool 100.

Figure 2:
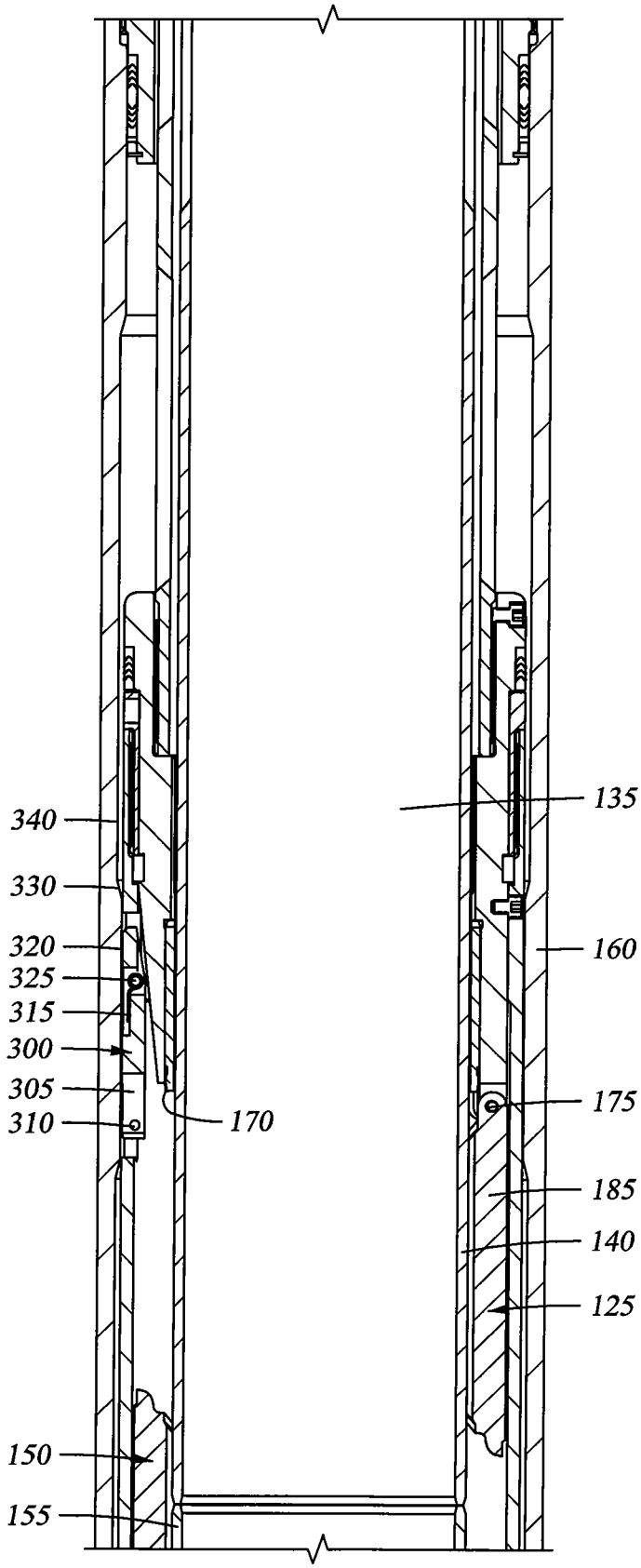
FIG. 2 is a cross-sectional view illustrating a flapper latch assembly for use with the first flapper valve.

FIG. 2 is a cross-sectional view illustrating a flapper latch assembly 300 for use with the first flapper valve 125. As will be described in relation to FIGS. 3-8, the flapper latch assembly 300 is generally configured to lock the first flapper valve 125 in the closed position. The flapper latch assembly 300 includes a body 305, a release mechanism 310, a biasing member 315, and a pin member 325. As shown, the flapper latch assembly 300 is in an unlocked position.

Figure 3:
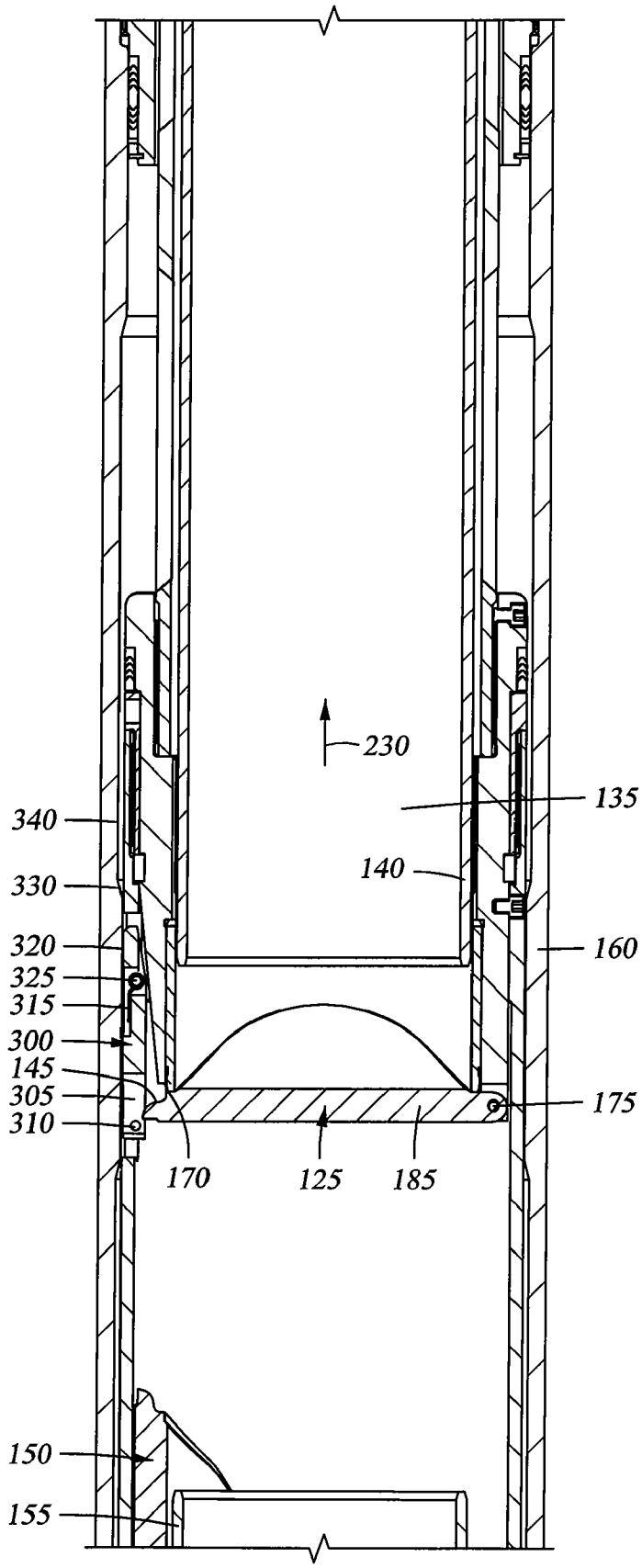
FIG. 3 is a cross-sectional view illustrating the flapper latch assembly in an unlocked position and the first flapper valve in a closed position.

FIG. 3 is a cross-sectional view illustrating the flapper latch assembly 300 in the unlocked position and the first flapper valve 125 in a closed position. In the closing sequence, the first flapper valve 125 is moved to the closed position first in order to protect the second flapper valve 150 from debris that may be dropped from the surface of the wellbore. Referring back to FIG. 1, in one embodiment, a shifting tool (not shown) having a plurality of fingers that mates with the profile 165 of the shifting sleeve 115 is used to move the first flapper valve 125 to the closed position. The shifting tool may be a mechanical tool that is initially disposed below the tool 100 and then urged through the bore 135 of the tool 100 until it mates with the upper profile 165. The shifting tool may also be a hydraulic shifting tool that includes fingers that selectively extend radially outward due to fluid pressure and mate with the profile 165. In either case, the shifting tool mates with the profile 165 in order to pull the shifting sleeve 115 toward the upper sub 105.

As the shifting sleeve 115 begins to move toward the upper sub 105, the shift and lock mechanism 130 starts the closing sequence of the flapper valves 125, 150. During the closing sequence, the shift and lock mechanism 130 moves the upper flow tube 140 away from the first flapper valve 125 in a direction as indicated by an arrow 230. A biasing member (not shown) attached to a flapper member 185 in the first flapper valve 125 rotates the flapper member 185 around a pin 175 until the flapper member 185 contacts and creates a sealing relationship with a valve seat 170. As illustrated, the flapper member 185 closes away from the lower sub 110. As such, the first flapper valve 125 is configured to seal from below. In other words, the first flapper valve 125 is capable of substantially preventing fluid flow from moving upward through the tool 100. In addition, as the shifting sleeve 115 moves toward the upper sub 105, the spring 120 is also compressed.

Figure 7:
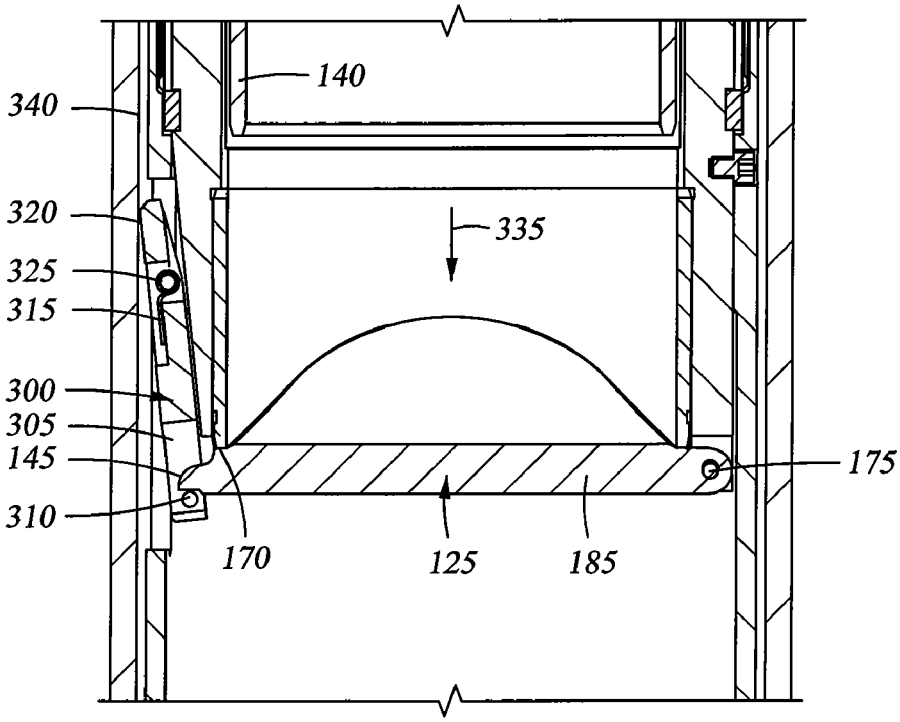
FIGS. 7 and 8 are cross-sectional views illustrating the actuation of a release mechanism in the flapper latch assembly.
Figure 8:
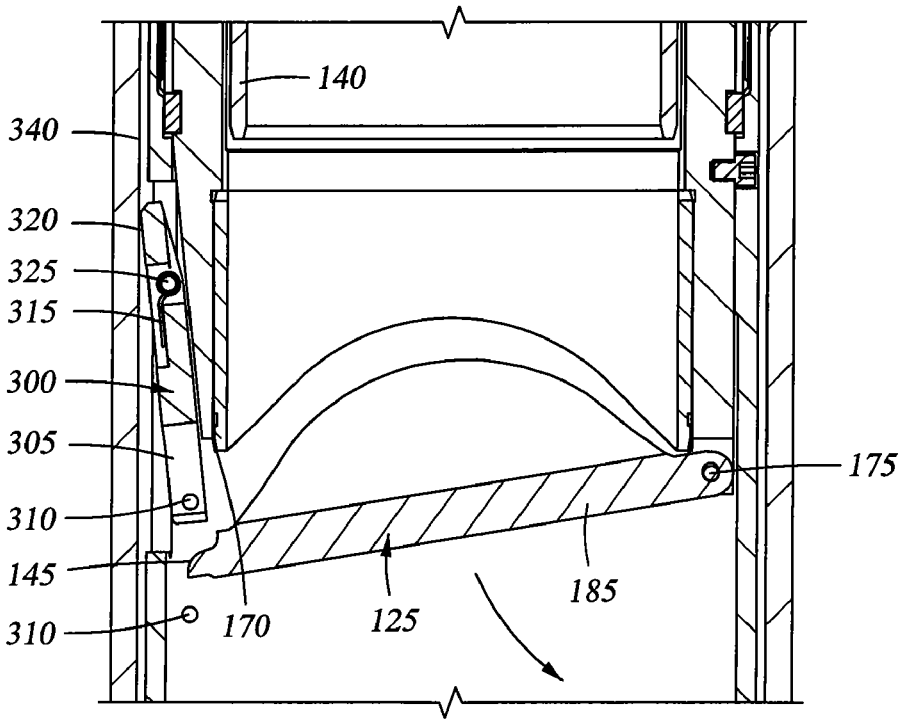

As illustrated in FIG. 3, the flapper latch assembly 300 is in the unlocked position and the first flapper valve 125 is in the closed position. As the shifting tool urges the sleeve further toward the upper sub, the flapper latch assembly 300 is activated to secure the first flapper valve 125 in the closed position. The flapper latch assembly 300 may be configured to allow the first flapper valve 125 to burp or crack open if necessary. This situation may occur when debris from the surface of the wellbore falls and lands on the first flapper valve 125. It should be noted that the flapper latch assembly 300 is not configured to allow the first flapper valve 125 to move to the full open position, unless a release mechanism is activated, as shown in FIGS. 7-8, but rather the flapper latch assembly 300 will only allow the first flapper valve 125 to crack open slightly. As such, the first flapper valve 125 in the closed position acts a barrier member to the second flapper valve 150 by substantially preventing large particles (i.e. a dropped drill string) from contacting and damaging the second flapper valve 150.

Figure 4:
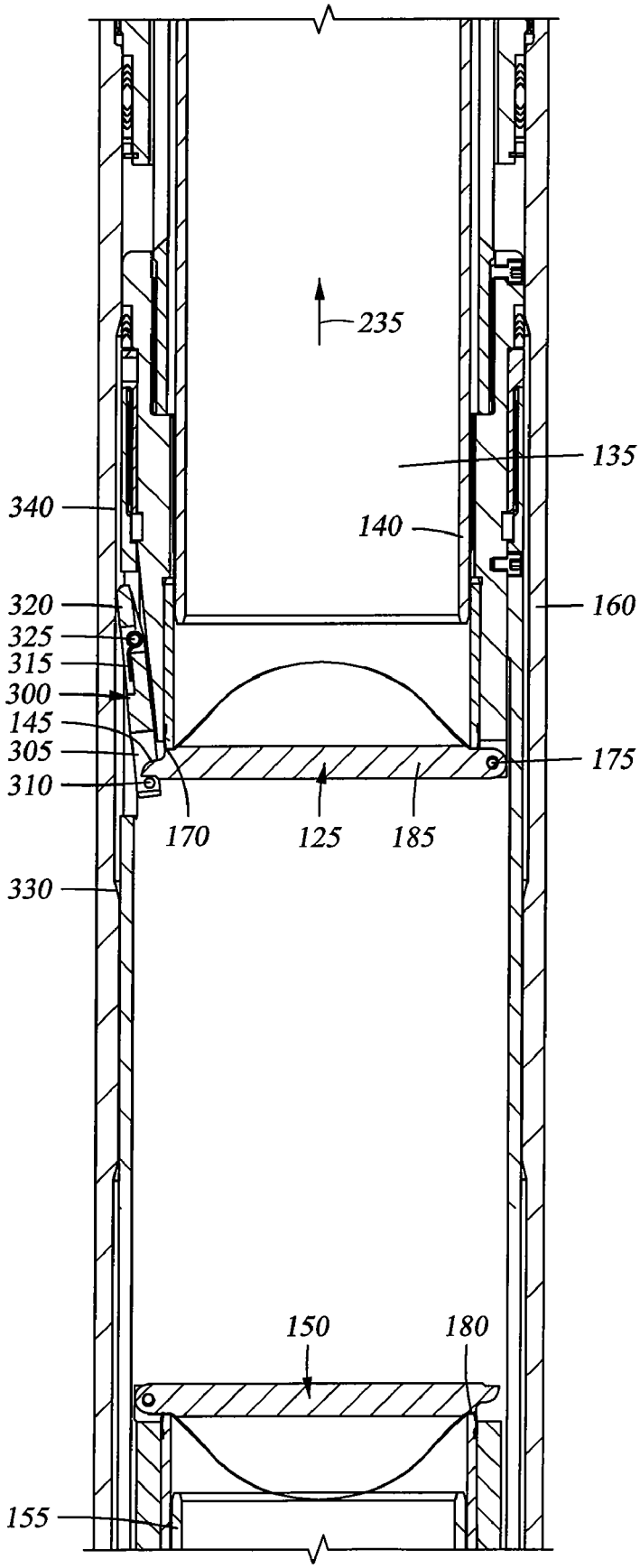
FIG. 4 is a cross-sectional view illustrating the flapper latch assembly in a locked position.

FIG. 4 is a cross-sectional view illustrating the flapper latch assembly 300 in a locked position. After the first flapper valve 125 is in the closed position and secured in place, the shifting tool continues to urge the sleeve toward the upper sub, thereby causing the flapper valves 125, 150 and the flapper latch assembly 300 to move together as a subsystem relative to the housing 160 in a direction as indicated by an arrow 235. The flapper latch assembly 300 moves in the housing 160 until the flapper latch assembly 300 is positioned proximate a recess 340 formed in the housing 160, thereby allowing the flapper latch assembly 300 to move from the unlocked position to the locked position. At that point, the biasing member 315 causes the body 305 to rotate around the pin member 325 to allow the flapper latch assembly 300 to engage an end portion 145 of the first flapper valve 125. At the same time, the second flapper valve 150 is moved in the housing 160 away from the lower flow tube 155, thereby allowing a flapper member in the second flapper valve 150 to rotate around a pivot point until the flapper member contacts and creates a sealing relationship with a valve seat 180. The flapper member closes away from the upper sub. As such, the second flapper valve 150 is configured to seal from above. In other words, the second flapper valve 150 is capable of substantially preventing fluid flow from moving downward through the tool 100. Thereafter, the shifting sleeve 115 is urged closer to the upper sub 105 and the flapper valves 125, 150 are held in the closed position by the shift and lock mechanism 130. Also, the spring 120 is in a full compressed state.

To open the valves 125, 150 according to one opening sequence, the second flapper valve 150 is moved to the open position first in order to allow the second flapper valve 150 to open in a clean environment by manipulating the shift and lock mechanism 130. As discussed herein, in one embodiment, the shift and lock mechanism 130 is a key and dog arrangement, whereby the plurality of dogs move in and out of the plurality of keys formed in the sleeves as the sleeves are shifted in the tool 100. The movement of the dogs and the sleeves causes the flapper valves 125, 150 to move between the open and the closed position. It should be understood, that the shift and lock mechanism 130 is not limited to this embodiment. Rather, the shift and lock mechanism 130 may be any type of arrangement capable of causing the flapper valves 125, 150 to move between the open and the closed position.

Figure 5:
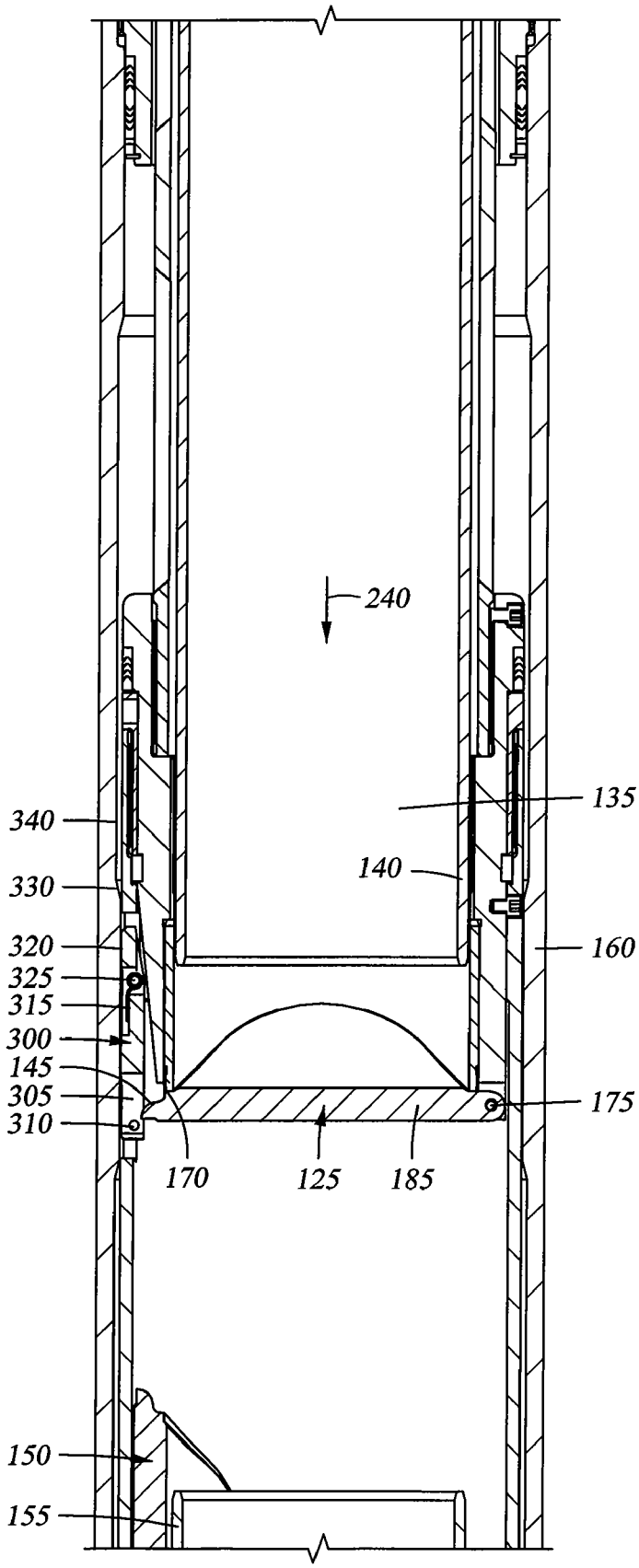
FIG. 5 is a cross-sectional view illustrating the flapper latch assembly in an unlocked position.

Prior to moving the second flapper valve 150 to the open position, the pressure around the second flapper valve 150 may be equalized by aligning a port (not shown) with a slot (not shown) formed in the flow tube 155 as the shifting sleeve 115 is moved toward the lower sub 110. Thereafter, the further movement of the shifting sleeve 115 toward the lower sub 110 causes the flapper valves 125, 150 and the flapper latch assembly 300 to move together as a subassembly relative to the housing 160 in a direction as indicated by an arrow 240. The flapper latch assembly 300 moves in the housing 160 until an edge 320 of the flapper body 305 contacts a slanted edge 330 in the housing 160. At that point, the flapper latch assembly 300 moves to the unlocked position as the contact between the edge 320 and the slanted edge 330 causes the flapper body 305 to rotate around the pin member 325, thereby causing the flapper latch assembly 300 to disengage from the end portion 145 of the flapper member 185. At the same time, the second flapper valve 150 moves in the housing 160 toward the lower flow tube 155. Contact of the second flapper valve 150 with the lower flow tube 155 overcomes a biasing member in the second flapper valve 150 such that the second flapper valve 150 moves from the closed position to the open position as shown in FIG. 5. As previously discussed, the movement of the shifting sleeve 115 toward the lower sub 110 may be accomplished by a variety of means. For instance, the shifting sleeve 115 may be urged toward the lower sub 110 by a hydraulic or mechanical shifting tool (not shown) that interacts with the profile 190 formed on the shifting sleeve 115. In turn, the shifting sleeve 115 manipulates the mechanism 130 in order to open the flapper valves 125, 150.

Figure 6:
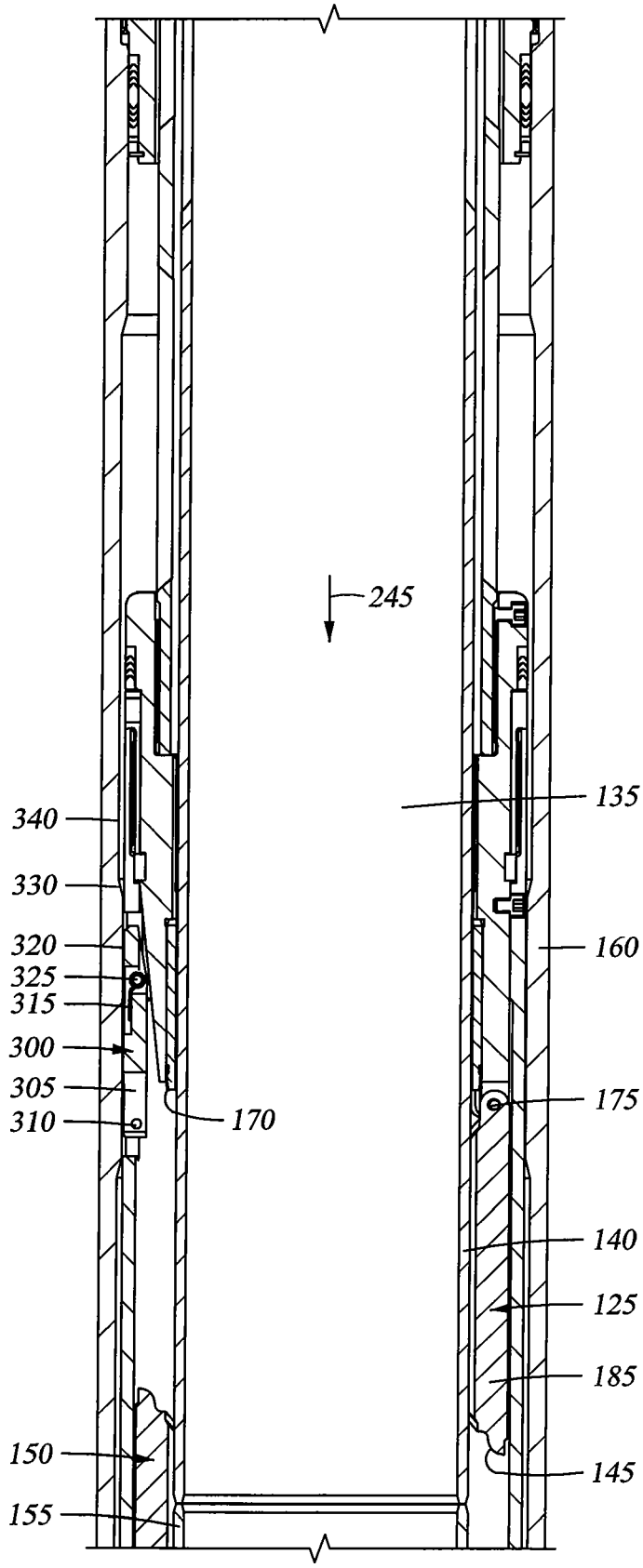
FIG. 6 is a cross-sectional view illustrating the first flapper valve and the second flapper valve in an open position and the flapper latch assembly in the unlocked position.

FIG. 6 is a cross-sectional view illustrating the first flapper valve 125 and the second flapper valve 150 in the open position and the flapper latch assembly 300 in the unlocked position. After the second flapper valve 150 is opened, the upper flow tube 140 moves toward the first flapper valve 125 as indicated by an arrow 245 as the shift and lock mechanism 130 is manipulated. Prior to the upper flow tube 140 contacting the flapper member 185 in the first flapper valve 125, a slot (not shown) formed in the upper flow tube 140 aligns with a port (not shown) to equalize the pressure around the first flapper valve 125. Thereafter, the upper flow tube 140 contacts the flapper member 185 in the first flapper valve 125 and causes the first flapper valve 125 to move from the closed position to the open position. Subsequently, the flapper valves 125, 150 are held in place by further manipulation of the shift and lock mechanism 130. The process of moving the flapper valves 125, 150 between the open position and the closed position may be repeated any number of times.

FIGS. 7 and 8 are cross-sectional views illustrating the actuation of a release mechanism in the flapper latch assembly. While the flapper latch assembly 300 is in the locked position, the release mechanism 310 may be activated to allow the first flapper valve 125 to move from the closed position to the open position. The release mechanism 310 is generally activated by applying a force to the first flapper valve 125 in the direction as indicated by the arrow in FIG. 7. In turn, the force on the first flapper valve 125 causes a portion of the force to act upon the release mechanism 310. At a predetermined force, the release mechanism 310 is activated, thereby allowing the first flapper valve 125 to move from the closed position to the open position as shown in FIG. 8. In one embodiment, the release mechanism 310 is a shearable member, such as a shear pin. In this embodiment, the shearable member is designed to fail at the predetermined force. It should be noted the predetermined force to activate the release mechanism 310 is generally less than a force that causes the pin 175 in the flapper latch 125 to fail. In this manner, the activation of the release mechanism 310 allows the first flapper valve 125 to move from the closed position to the open position.

In one embodiment, a hydraulic chamber arrangement is used to move the flapper valves. For instance, the flapper valves in the downhole tool are moved to the open position by actuating the shift and lock mechanism. In this embodiment, the shift and lock mechanism is actuated when a pressure differential between an ambient chamber and tubing pressure in the bore of the tool reaches a predetermined pressure. The chamber is formed at the surface between two seals. As the tool is lowered into the wellbore, a hydrostatic pressure is developed which causes a pressure differential between the pressure in the chamber and the bore of the tool. At a predetermined differential pressure, a shear pin (not shown) is sheared, thereby causing the spring to uncompress and shift the shifting sleeve toward the lower sub in order to release the flapper valves and start the opening sequence. The shear pin may be selected based upon the depth location in the wellbore that the shift and lock mechanism is to be actuated.

While the foregoing is directed to embodiments of the present invention, other and further embodiments of the invention may be devised without departing from the basic scope thereof, and the scope thereof is determined by the claims that follow.

The invention claimed is:

1. An apparatus for isolating a zone in a wellbore, the apparatus comprising:

a body having a bore;

a first flapper member and a second flapper member disposed in the bore, each flapper member selectively rotatable between an open position and a closed position multiple times, wherein the first flapper member is rotated from the open position to the closed position in a first direction and the second flapper member is rotated from the open position to the closed position in a second direction, wherein the first flapper member is operable to move to the open position after the second flapper member is in the open position; and a flapper latch assembly disposed in the bore, the flapper latch assembly movable between an unlocked position and a locked position, wherein the flapper latch assembly is configured to hold the first flapper member in the closed position when the flapper latch assembly is in the locked position.

2. The apparatus of claim 1, wherein the flapper latch assembly includes a latch body, a pin member, and a biasing member.

3. The apparatus of claim 2, wherein the biasing member causes the latch body to rotate around the pin member as the flapper latch assembly moves between the unlocked position and the locked position.

4. The apparatus of claim 3, wherein the flapper latch assembly is biased in the locked position.

5. The apparatus of claim 1, wherein the flapper latch assembly is moved from the unlocked position to the locked position when the flapper latch assembly is moved relative to the body into a recess formed in the bore of the body.

6. The apparatus of claim 5, wherein the flapper latch assembly is moved from the locked position to the unlocked position when the flapper latch assembly is moved out of the recess formed in the bore of the body.

7. The apparatus of claim 1, wherein the flapper latch assembly includes a release mechanism that is configured to allow the first flapper member to move from the closed position to the open position when the flapper latch assembly is in the locked position.

8. The apparatus of claim 7, wherein the release mechanism includes a shearable member.

9. The apparatus of claim 1, wherein the first direction is opposite the second direction.

10. The apparatus of claim 1, further including an upper sub and a lower sub attached to the body, whereby the first flapper member moves to the closed position toward the upper sub and the second flapper member moves to the closed position toward the lower sub.

11. A method for selectively isolating a zone in a wellbore, the method comprising:

positioning a downhole tool in the wellbore, the downhole tool having a body, a first flapper member, a second flapper member, and a flapper latch assembly, whereby each flapper member is initially in an open position while positioning;

moving the first flapper member to a closed position by rotating the first flapper member in a first direction;

moving the second flapper member to a closed position by rotating the second flapper member in a second direction;

moving a flapper latch assembly from an unlocked position to a locked position, whereby the flapper latch assembly is configured to hold the first flapper member in the closed position when the flapper latch assembly is in the locked position; and moving the flapper latch assembly relative to the body and into a recess formed in the body, thereby allowing the flapper latch assembly to move from the unlocked position to the locked position.

12. The method of claim 11, wherein a latch body of the flapper latch assembly rotates around a pin member as a result of moving the flapper latch assembly into the recess.

13. The method of claim 11, further comprising moving the flapper latch assembly out of the recess formed in the body, thereby allowing the flapper latch assembly to move from the locked position to the unlocked position.

14. The method of claim 11, further comprising activating a release mechanism in the flapper latch assembly, thereby allowing the first flapper member to move from the closed position to the open position when the flapper latch assembly is in the locked position.

15. The method of claim 11, further comprising shearing a shearable member in the flapper latch assembly, thereby allowing the first flapper member to move from the closed position to the open position when the flapper latch assembly is in the locked position.

16. A flapper latch assembly for use with a flapper valve, the flapper latch assembly comprising:

a body rotatable between an unlocked position and a locked position, wherein the body includes an end configured to engage a portion of the flapper valve when the flapper valve is in a closed position and the body is in the locked position;

a biasing member attached to the body, wherein the biasing member is configured to bias the body in the locked position; and a release mechanism that is configured to allow the flapper valve to move from the closed position to an open position when the body is in the locked position.

17. The flapper latch assembly of claim 16, wherein the release mechanism includes a shearable member.

18. An apparatus for isolating a zone in a wellbore, the apparatus comprising:

a body having a bore;

a first flapper member and a second flapper member disposed in the bore, each flapper member selectively rotatable between an open position and a closed position multiple times, wherein the first flapper member is rotated from the open position to the closed position in a first direction and the second flapper member is rotated from the open position to the closed position in a second direction; and a flapper latch assembly disposed in the bore, the flapper latch assembly movable between an unlocked position and a locked position, wherein the flapper latch assembly is configured to hold the first flapper member in the closed position when the flapper latch assembly is in the locked position, wherein the flapper latch assembly includes a latch body, a pin member, and a biasing member, wherein the biasing member causes the latch body to rotate around the pin member as the flapper latch assembly moves between the unlocked position and the locked position.

19. An apparatus for isolating a zone in a wellbore, the apparatus comprising:

a body having a bore;

a first flapper member and a second flapper member disposed in the bore, each flapper member selectively rotatable between an open position and a closed position multiple times, wherein the first flapper member is rotated from the open position to the closed position in a first direction and the second flapper member is rotated from the open position to the closed position in a second direction; and a flapper latch assembly disposed in the bore, the flapper latch assembly movable between an unlocked position and a locked position, wherein the flapper latch assembly is configured to hold the first flapper member in the closed position when the flapper latch assembly is in the locked position, wherein the flapper latch assembly is moved from the unlocked position to the locked position when the flapper latch assembly is moved relative to the body into a recess formed in the bore of the body.

20. A method for selectively isolating a zone in a wellbore, the method comprising:

positioning a downhole tool in the wellbore, the downhole tool having a body, a first flapper member, a second flapper member, and a flapper latch assembly, whereby each flapper member is initially in an open position;

moving the first flapper member to a closed position by rotating the first flapper member in a first direction;

moving the second flapper member to a closed position by rotating the second flapper member in a second direction;

moving a flapper latch assembly from an unlocked position to a locked position, whereby the flapper latch assembly is configured to hold the first flapper member in the closed position when the flapper latch assembly is in the locked position; and shearing a shearable member in the flapper latch assembly, thereby allowing the first flapper member to move from the closed position to the open position when the flapper latch assembly is in the locked position.

21. An apparatus for locking and unlocking a flapper valve, comprising:

a body;

a pin member coupled to the body;

a shearable release mechanism coupled to the body; and a biasing member configured to rotate the body around the pin member to thereby position the shearable release mechanism into engagement with a portion of the flapper valve.

22. The apparatus of claim 21, wherein the biasing member is configured to rotate the body into a first position to lock the flapper valve in a closed position.

23. The apparatus of claim 22, wherein the release mechanism is configured to allow the flapper valve to move from the closed position to an open position while the body is in the first position.

24. The apparatus of claim 21, further comprising a housing, wherein the body is disposed in and movable relative to the longitudinal axis of the housing.

25. The apparatus of claim 24, where the body is rotatable around the pin member by the biasing member when the body is moved relative to the housing into a recess formed in the housing.

26. The apparatus of claim 25, wherein the body is rotatable around the pin member by the housing when the body is moved out of the recess formed in the housing to thereby position the release mechanism out of engagement with the portion of the flapper valve.

27. A method for locking and unlocking a flapper valve, comprising:

positioning a flapper valve and a latch assembly in a housing;

closing the flapper valve;

moving the latch assembly and the flapper valve relative to the longitudinal axis of the housing; and locking the flapper valve in a closed position with the latch assembly by moving the latch assembly into a recess formed in the housing.

28. The method of claim 27, further comprising unlocking the flapper valve from engagement with the latch assembly by moving the latch assembly out of the recess formed in the housing to permit the flapper valve to move into an open position.

29. The method of claim 27, further comprising rotating a body of the latch assembly into engagement with the flapper valve to lock the flapper valve in the closed position.

30. The method of claim 29, further comprising positioning a release mechanism of the latch assembly into engagement with the flapper valve to lock the flapper valve in the closed position.

31. The method of claim 30, further comprising actuating the release mechanism to permit the flapper valve to move into an open position while the body remains in a rotated position.

32. The method of claim 31, wherein actuating the release mechanism comprises shearing a shearable member.

33. The method of claim 27, further comprising holding the flapper valve in an open position with a first member and moving the first member from engagement with the flapper valve to permit closing of the flapper valve.

34. The method of claim 33, wherein the first member is a flow tube that is movable through the flapper valve.

35. The method of claim 27, further comprising rotating a body of the latch assembly with a biasing member by moving the body into the recess of the housing to lock the flapper valve in the closed position.

36. The method of claim 27, further comprising rotating a body of the latch assembly with the housing by moving the body out of the recess of the housing to unlock the flapper valve and permit the flapper valve to move into an open position.

37. A method for locking and unlocking a flapper valve, comprising:

positioning a flapper valve and a latch assembly in a housing;

holding the flapper valve in an open position with a first member and moving the first member from engagement with the flapper valve to permit closing of the flapper valve;

closing the flapper valve; and locking the flapper valve in a closed position with the latch assembly by moving the latch assembly into a recess formed in the housing.

38. The method of claim 37, wherein the first member is a flow tube that is movable through the flapper valve.

39. A method for locking and unlocking a flapper valve, comprising:

positioning a flapper valve and a latch assembly in a housing;

closing the flapper valve;

locking the flapper valve in a closed position with the latch assembly by moving the latch assembly into a recess formed in the housing; and rotating a body of the latch assembly with a biasing member by moving the body into the recess of the housing to lock the flapper valve in the closed position.

40. A method for locking and unlocking a flapper valve, comprising:

positioning a flapper valve and a latch assembly in a housing;

closing the flapper valve;

locking the flapper valve in a closed position with the latch assembly by moving the latch assembly into a recess formed in the housing; and rotating a body of the latch assembly with the housing by moving the body out of the recess of the housing to unlock the flapper valve and permit the flapper valve to move into an open position.

* * * * *